US010464069B2

(12) United States Patent
Simons et al.

(10) Patent No.: US 10,464,069 B2
(45) Date of Patent: Nov. 5, 2019

(54) AGITATOR BALL MILL

(71) Applicant: Willy A. Bachofen AG, Muttenz (CH)

(72) Inventors: Benedikt Simons, Schopfheim (DE); Guillaume Martin, Habsheim (FR)

(73) Assignee: Willy A. Bachofen AG, Muttenz (CH)

( * ) Notice: Subject to any disclaimer, the term of this patent is extended or adjusted under 35 U.S.C. 154(b) by 356 days.

(21) Appl. No.: 15/116,381

(22) PCT Filed: Feb. 6, 2015

(86) PCT No.: PCT/EP2015/052463
§ 371 (c)(1),
(2) Date: Aug. 3, 2016

(87) PCT Pub. No.: WO2015/118090
PCT Pub. Date: Aug. 13, 2015

(65) Prior Publication Data

US 2017/0014830 A1 Jan. 19, 2017

(30) Foreign Application Priority Data

Feb. 7, 2014 (EP) ..... 14154350

(51) Int. Cl.
*B02C 17/16* (2006.01)
*B02C 17/20* (2006.01)

(52) U.S. Cl.
CPC ..... *B02C 17/163* (2013.01); *B02C 17/16* (2013.01); *B02C 17/161* (2013.01);
(Continued)

(58) Field of Classification Search
CPC ..... B02C 17/00; B02C 17/0002; B02C 17/10; B02C 17/163; B02C 17/16; B02C 17/168;
(Continued)

(56) References Cited

U.S. PATENT DOCUMENTS 3,550,915 A 12/1970 Kaspar et al.
5,597,126 A * 1/1997 Frommherz ..... B02C 17/163 241/172

(Continued)

FOREIGN PATENT DOCUMENTS

CN 102794215 A 11/2012
EP 0627262 A1 12/1994

(Continued)

OTHER PUBLICATIONS

International Search Report for PCT/EP2015/052463, dated Apr. 8, 2015.

*Primary Examiner* — Shelley M Self
*Assistant Examiner* — Katie L. Parr
(74) *Attorney, Agent, or Firm* — Merchant & Gould P.C.

(57) ABSTRACT

An agitator ball mill includes a grinding chamber, a rotatably mounted agitator shaft, which protrudes into the grinding chamber and on which agitator elements, in the form of paddle wheels, are arranged spaced apart from one another axially, and an inlet for supplying material to be ground and grinding bodies and an outlet for removal of the ground material. The agitator elements are constructed in such a way that, during operation, they convey a mixture consisting of material to be ground or dispersed and grinding bodies through their interior outwards away from the agitator shaft. In the grinding chamber there are arranged return conveyor elements which are joined to the agitator shaft for conjoint rotation therewith and which convey the mixture laterally alongside and/or between the agitator elements inwards towards the agitator shaft.

12 Claims, 8 Drawing Sheets

(52) U.S. Cl.
CPC ..... *B02C 17/166* (2013.01); *B02C 17/168* (2013.01); *B02C 17/20* (2013.01); *B02C 2017/165* (2013.01)

(58) Field of Classification Search
CPC ..... B02C 17/166; B02C 17/161; B02C 17/20; B02C 2017/165; B02C 17/002; B02C 17/04; B02C 13/00; B02C 13/06; B02C 13/08; B02C 13/18; B02C 13/28; B02C 13/2804; B02C 2013/145
USPC ..... 241/170–174, 153
See application file for complete search history.

(56) References Cited

U.S. PATENT DOCUMENTS

| | | | | |
|---|---|---|---|---|
| 5,620,147 | A * | 4/1997 | Newton | B02C 17/16 241/171 |
| 2011/0036935 | A1* | 2/2011 | Stehr | B02C 17/161 241/69 |
| 2011/0303774 | A1* | 12/2011 | Jeker | B02C 17/161 241/30 |
| 2013/0264402 | A1* | 10/2013 | Pausch | B02C 17/16 241/79 |

FOREIGN PATENT DOCUMENTS

| | | | |
|---|---|---|---|
| EP | 2272591 | A1 | 1/2011 |
| WO | 2010/112274 | A1 | 10/2010 |

* cited by examiner

AGITATOR BALL MILL

This application is a National Stage of PCT/EP2015/052463, filed 6 Feb. 2015, which claims benefit of 14154350.4, filed 7 Feb. 2014 in Europe, which applications are incorporated herein by reference. To the extent appropriate, a claim of priority is made to each of the above disclosed applications.

BACKGROUND OF THE INVENTION

The present invention relates to an agitator ball mill in accordance with the independent claim.

An agitator ball mill of the generic kind is describedrein comprises a substantially cylindrical grinding chamber which is, for example, in WO 2010/112274. The agitator ball mill described the bounded by a cylindrical wall and by an inlet-side end wall and an outlet-side end wall, and a rotatably mounted agitator shaft on which paddle-wheel-like agitator elements, also referred to as accelerators, are arranged spaced apart from one another axially inside the grinding chamber. In the vicinity of the inlet-side end wall there is arranged an inlet for supplying material to be ground and grinding bodies and in the outlet-side end wall there is provided an outlet for removal of the ground material, which outlet is separated from the grinding chamber by a separator screen that holds back grinding bodies. During operation, the agitator shaft and accordingly the agitator elements that are joined thereto for conjoint rotation therewith are set in rotation by an external motor. Agitator ball mills of similar construction are described, for example, in EP 0 627 262 and EP 2 272 591.

During the grinding and/or dispersing process, those agitator ball mills which are provided with paddle-wheel-like agitator elements convey a portion of the mixture formed from grinding bodies and the material being ground and/or dispersed radially outwards, whereupon at least a portion of the mixture flows in the direction of the agitator shaft and is thence sucked back into the conveyor chambers of the agitator elements. That process is referred to hereinbelow as the grinding body cycle.

In known agitator ball mills of that type, in certain configurations the problem arises that during the grinding or dispersing process only an insufficient portion of the radially outwardly conveyed mixture formed from grinding bodies and the material being ground and/or dispersed flows in the direction of the agitator shaft and is thence sucked back into the conveyor channels of the agitator elements. This occurs particularly when the kinetic energy of the grinding bodies is so great that their inertial forces are greater than the tractive forces of the material being ground and/or dispersed. In that case a separation takes place between grinding bodies and the material being ground and/or dispersed, that is to say the material being ground and/or dispersed is caught up by the intended grinding body cycle while the majority of the grinding bodies become compacted towards the periphery of the grinding chamber. This can have the result, firstly, that product flowing subsequently into the grinding chamber collects on the compacted grinding bodies and, as a result, the pressure in the grinding chamber initially rises until the layer of grinding bodies breaks open locally under the effect of the compressive forces and the pressure then spontaneously falls again. This can lead to vibrations in the agitator ball mill. A further possible consequence of the accumulation of grinding bodies towards the periphery of the grinding chamber is a sub-optimum grinding result.

SUMMARY OF THE INVENTION

The objective of the present invention is to improve an agitator ball mill of the generic kind in such a way that the grinding bodies cannot accumulate at the periphery of the grinding chamber, or at most do so only to a greatly reduced extent, but rather are as completely as possible carried along by the material being ground and/or dispersed and are thus fed into the grinding body cycle.

The problem underlying the invention is solved according to the invention by an agitator ball mill as specified by the features of the independent claim. Further advantageous aspects will be found in the features of the dependent claims.

The agitator ball mill according to the invention comprises a grinding chamber, a rotatably mounted agitator shaft, which protrudes at least partly into the grinding chamber and on which agitator elements are arranged spaced apart from one another axially inside the grinding chamber, and an inlet for supplying material to be ground and grinding bodies and an outlet for removal of the ground material, wherein the agitator elements each have at least one conveyor chamber and are constructed in such a way that, during operation, they convey a mixture consisting of material to be ground or dispersed and grinding bodies through their at least one conveyor chamber outwards away from the agitator shaft, and wherein in the grinding chamber there are arranged return conveyor elements which are joined to the agitator shaft for conjoint rotation therewith and which, during operation, convey the mixture laterally alongside and/or between the agitator elements inwards towards the agitator shaft.

The term "through" the conveyor chamber in this context means that the material being ground or dispersed is conveyed away from the agitator shaft into the conveyor chamber, is conveyed towards the outside in the conveyor chamber, and then at the outside is conveyed out of the conveyor chamber again. The return conveyor elements generate a flow-field directed inwards towards the agitator shaft, which increases the tractive forces of the material being ground and/or dispersed. Grinding bodies that come into contact with those return conveyor elements are given an impetus that is likewise directed inwards towards the agitator shaft. Both support the maintenance of the desired grinding body cycle.

In accordance with one aspect of the agitator ball mill according to the invention, the return conveyor elements are arranged laterally on the agitator elements. "Laterally" means that the return conveyor elements are arranged on those sides of the agitator elements which face in the direction of the rotational axis of the agitator shaft (the rotational axis of the agitator shaft is therefore perpendicular to those sides), for example the return conveyor elements project from the lateral end faces of the agitator elements. In accordance with a further aspect of the agitator ball mill according to the invention, the return conveyor elements are arranged spaced apart laterally alongside and/or between the agitator elements. Both aspects are especially advantageous from a constructional point of view.

In accordance with a further aspect of the agitator ball mill according to the invention, the return conveyor elements are arranged laterally on at least one separate (preferably disc-shaped) carrier which is joined to the agitator shaft for conjoint rotation therewith. As a result, the agitator elements and the return conveyor elements can be optimised and produced independently of one another.

In accordance with a further aspect of the agitator ball mill according to the invention, the return conveyor elements are in the form of return conveyor paddles.

In that case, in accordance with a further aspect, the agitator elements can be in the form of paddle wheels and have guide paddles which are angled obliquely inwards from the outside in the direction of rotation of the agitator elements and are preferably constructed so as to be curved in the direction of rotation of the agitator elements, the return conveyor paddles being angled obliquely inwards against the direction of rotation of the agitator elements.

In accordance with a further aspect of the agitator ball mill according to the invention, the return conveyor paddles are arranged in at least one return conveyor unit, constructed in the form of a paddle wheel, which is joined to the agitator shaft for conjoint rotation therewith.

In accordance with a further aspect of the agitator ball mill according to the invention, the return conveyor paddles are constructed so as to be curved in the direction of rotation.

In that case the radius of curvature of the return conveyor paddles can be, for example, from 40% to 70% of the outer diameter of the agitator elements.

In accordance with a further aspect of the agitator ball mill according to the invention, the return conveyor paddles each have an inner end and an outer end, wherein the return conveyor paddles, at their inner ends, enclose an angle with the circumferential direction at the location of the respective inner end, which angle is in the range of from 5° to 30°.

In accordance with a further aspect of the agitator ball mill according to the invention, the agitator elements arranged on the agitator shaft are in the form of single-chamber agitator elements and/or in the form of two-chamber agitator elements and each have the same outer diameter, the spacing between a single-chamber agitator element and an adjacently arranged single-chamber agitator element or between a single-chamber agitator element and an adjacently arranged two-chamber agitator element being in the range of from 10% to 20% of the outer diameter of the agitator elements, and the spacing between a two-chamber agitator element and an adjacently arranged two-chamber agitator element being in the range of from 30% to 40% of the outer diameter of the agitator elements. As a result, the grinding body cycle is further optimised.

In accordance with a further independent inventive concept, the agitator ball mill according to the invention comprises a grinding chamber, a rotatably mounted agitator shaft, which protrudes at least partly into the grinding chamber and on which agitator elements are arranged spaced apart from one another axially inside the grinding chamber, and an inlet for supplying material to be ground and grinding bodies and an outlet for removal of the ground material, wherein the agitator elements each have at least one conveyor chamber and are constructed in such a way that, during operation, they convey a mixture consisting of material to be ground or dispersed and grinding bodies through their at least one conveyor chamber outwards away from the agitator shaft, wherein the agitator elements arranged on the agitator shaft are in the form of single-chamber agitator elements and/or in the form of two-chamber agitator elements and each have the same outer diameter, the spacing between a single-chamber agitator element and an adjacently arranged single-chamber agitator element or between a single-chamber agitator element and an adjacently arranged two-chamber agitator element being in the range of from 10% to 20% of the outer diameter of the agitator elements, and the spacing between a two-chamber agitator element and an adjacently arranged two-chamber agitator element being in the range of from 30% to 40% of the outer diameter of the agitator elements.

In accordance with this inventive concept, the problem underlying the invention, which problem is that of the accumulation of grinding bodies in the periphery of the grinding chamber, is solved by the special arrangement of the agitator elements relative to one another, as a result of which the grinding bodies are carried along by the material being ground and/or dispersed and are thus fed into the grinding body cycle.

The following further aspects are to be understood in combination with the inventive concept just described having the special spacings between the agitator elements.

In accordance with one aspect, in the grinding chamber there are arranged return conveyor elements which are joined to the agitator shaft for conjoint rotation therewith and which, during operation, convey the mixture laterally alongside and/or between the agitator elements inwards towards the agitator shaft. Such additional return conveyor elements effect a further improvement of the grinding body cycle.

In accordance with a further aspect, the return conveyor elements are arranged laterally on the agitator elements. In accordance with a further aspect, the return conveyor elements are arranged spaced apart laterally alongside and/or between the agitator elements.

In accordance with a further aspect, the return conveyor elements are arranged laterally on at least one separate (preferably disc-shaped) carrier which is joined to the agitator shaft for conjoint rotation therewith.

In accordance with a further aspect, the return conveyor elements are in the form of return conveyor paddles.

In accordance with a further aspect, the agitator elements are in the form of paddle wheels and have guide paddles which are angled obliquely inwards from the outside in the direction of rotation of the agitator elements and are preferably constructed so as to be curved in the direction of rotation of the agitator elements, the return conveyor paddles being angled obliquely inwards from the outside against the direction of rotation of the agitator elements.

In accordance with a further aspect, the return conveyor paddles are arranged in at least one return conveyor unit, constructed in the form of a paddle wheel, which is joined to the agitator shaft for conjoint rotation therewith.

In accordance with a further aspect, the return conveyor paddles are constructed so as to be curved in the direction of rotation. In that case the radius of curvature of the return conveyor paddles can be, for example, from 40% to 70% of the outer diameter of the agitator elements.

In accordance with a further aspect, the return conveyor paddles each have an inner end and an outer end, wherein the return conveyor paddles, at their respective inner ends, enclose an angle with the circumferential direction at the location of the respective inner end, which angle is in the range of from 5° to 30°.

Further advantageous aspects will be found in the following description of exemplary embodiments of the agitator ball mill according to the invention with reference to the drawing, wherein:

DETAILED DESCRIPTION OF THE PREFERRED EMBODIMENTS

The following observations apply in respect of the description which follows: where, for the purpose of clarity of the drawings, reference symbols are included in a Figure but are not mentioned in the directly associated part of the description, reference should be made to the explanation of those reference symbols in the preceding or subsequent parts of the description. Conversely, to avoid overcomplication of the drawings, reference symbols that are less relevant for immediate understanding are not included in all Figures. In that case, reference should be made to the other Figures. Furthermore, the terms "upstream" and "downstream" are to be understood in relation to the general direction of the flow of material being ground through the agitator ball mill, that is to say from the inlet to the outlet. As the "agitator elements", hereinbelow "accelerators" are described, so that the terms are used synonymously, but in principle the agitator elements are not limited to the accelerators described.

Figure 1:
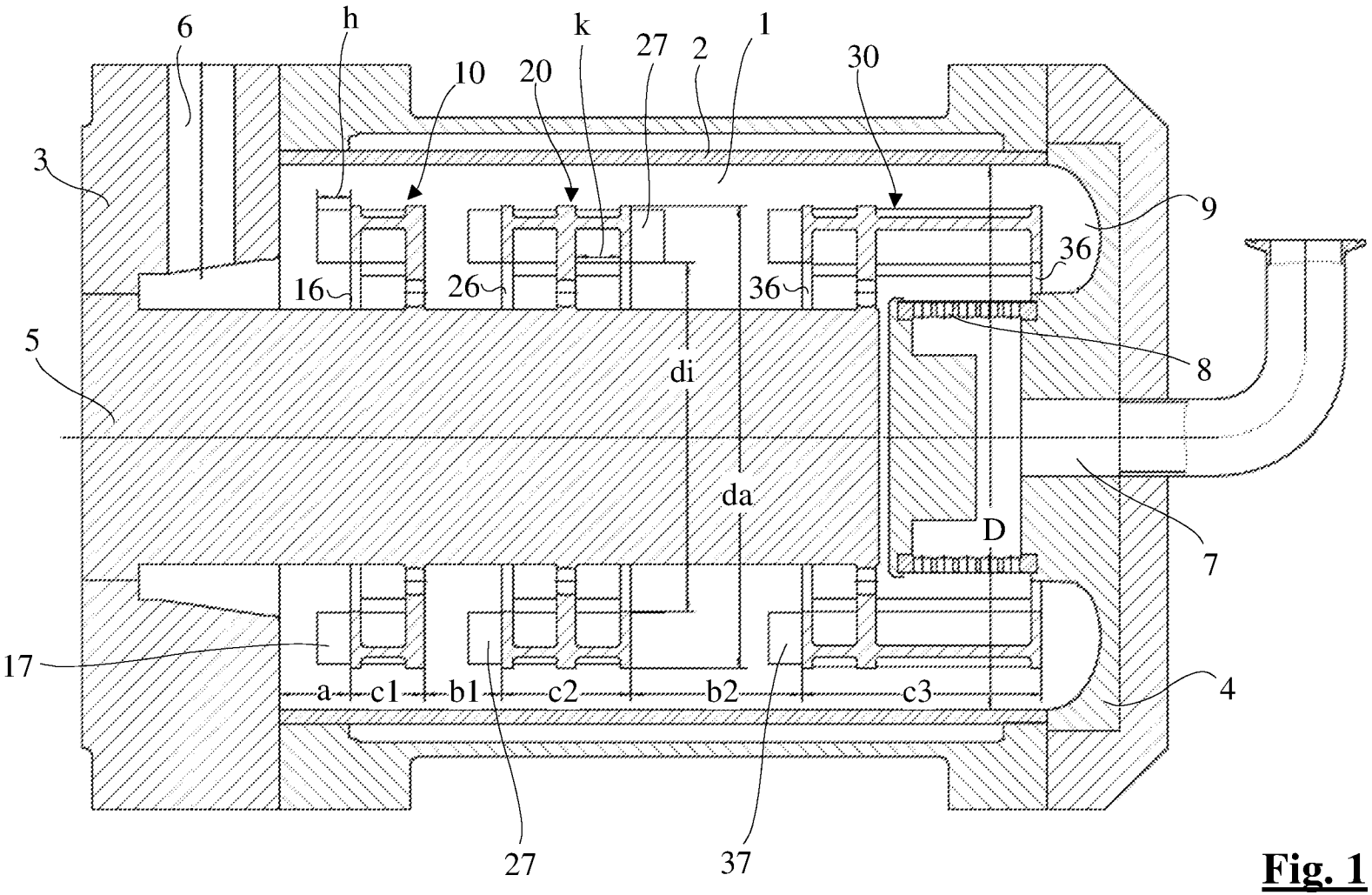
FIG. 1 shows an axial section through a first exemplary embodiment of the agitator ball mill according to the invention.

As the sectional view of FIG. 1 shows, the agitator ball mill according to the invention comprises a substantially cylindrical grinding chamber 1 which is bounded by a cylindrical wall 2 and by an inlet-side end wall 3 and an outlet-side end wall 4. Passing through the inlet-side end wall 3 there is an agitator shaft 5 which is rotatably mounted externally or in the end wall and on which three paddle-wheel-like agitator elements or accelerators 10, 20, 30 are arranged spaced apart from one another axially inside the grinding chamber 1. The accelerators 10, 20 and 30 are joined to the agitator shaft for conjoint rotation therewith and during operation are driven in rotation thereby. In the vicinity of the inlet-side end wall 3 there is arranged an inlet 6 for supplying material to be ground and grinding bodies and in the outlet-side end wall 4 there is provided an outlet 7 for removal of the ground material, the outlet 7 being separated from the grinding chamber 1 by a separator screen 8 that holds back the grinding bodies. In the outlet-side end wall 4 there is an annular channel 9 which is open towards the interior of the grinding chamber 1. During operation, the agitator shaft and accordingly the agitator elements or accelerators that are joined thereto for conjoint rotation therewith are set in rotation by an external motor (not shown).

Figure 4:
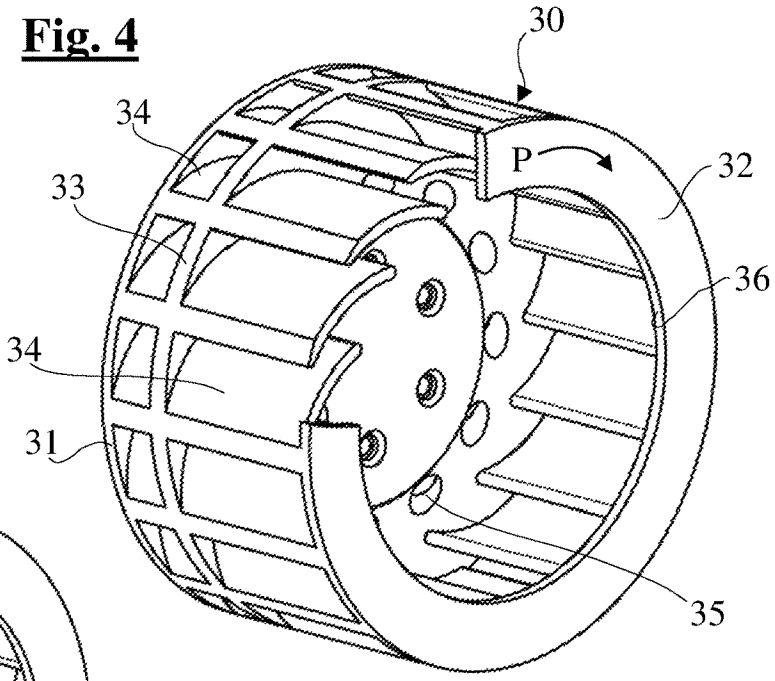
FIG. 2-4 show three accelerators, each in a perspective oblique view.
Figure 3:
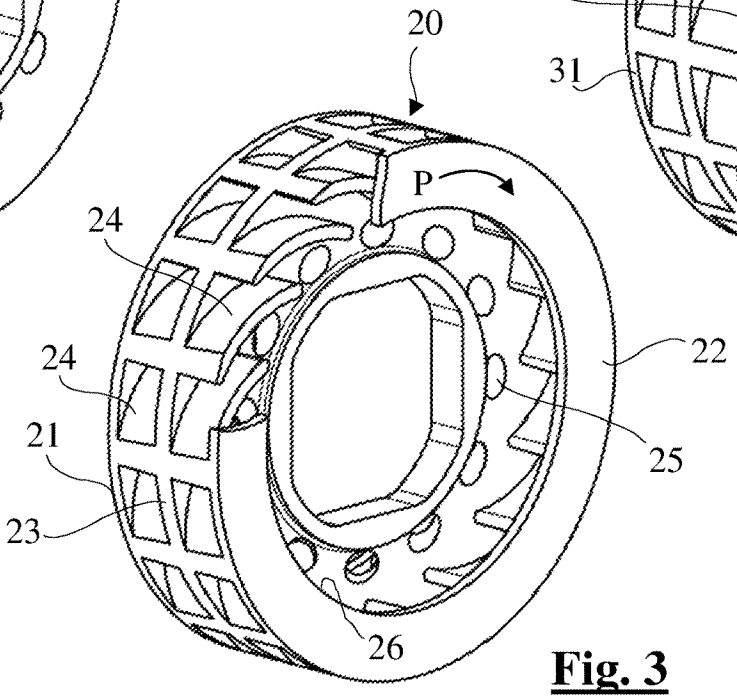
Figure 2:
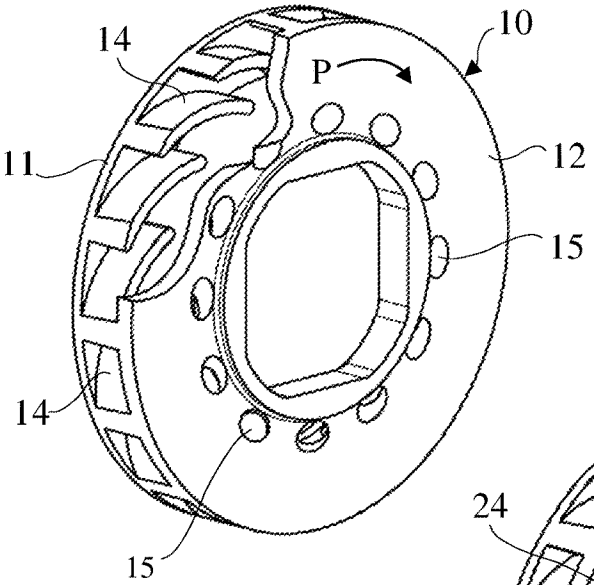

The basic structure of the three accelerators 10, 20 and 30 can best be seen in the partially cutaway oblique perspective views of FIGS. 2 to 4. Those Figures do not yet show the elements essential to the invention; they will be discussed further below.

The accelerator 10, referred to hereinbelow as a single-chamber accelerator, comprises two parallel annular discs 11 and 12, between which there are arranged curved guide paddles 14 which extend obliquely inwards from the outer periphery of the discs in direction of rotation P. Close to the agitator shaft, the disc 12 is provided with a series of openings 15 through which the mixture of material to be ground and grinding bodies can enter the accelerator 10. The openings 15 can also be directed at an angle of from 40° to 50° with respect to the axis of the agitator shaft or can be of slotted construction. The disc 11 has a central opening 16 (FIG. 1) of relatively large diameter, which serves the same purpose (entry of the mixture into the accelerator). The two annular discs 11 and 12 define between them a conveyor chamber and, together with the guide paddles 14, form a single-chamber paddle wheel which, on rotation of the agitator shaft 5 (FIG. 1) and accordingly of the accelerator 10 in direction of rotation P, conveys the mixture of material to be ground and grinding bodies located in the conveyor chamber towards the outside in the direction towards the periphery (cylindrical wall 2) of the grinding chamber 1.

The accelerator 20 differs from the accelerator 10 in that it is constructed as a two-chamber accelerator. It comprises three parallel annular discs 21, 22 and 23 between which there are arranged curved guide paddles 24 which extend obliquely inwards from the outer periphery of the discs in direction of rotation P. The middle disc 23 forms the supporting element and is arranged on the agitator shaft 5 for conjoint rotation therewith. Close to the agitator shaft, the middle disc 23 is also provided with a series of openings 25 through which the mixture of material to be ground and grinding bodies can pass. The openings 25 can also be directed at an angle of from 40° to 50° with respect to the axis of the agitator shaft or can be of slotted construction. The two outer discs 21 and 22 each have a central opening 26 of relatively large diameter, through which the mixture of material to be ground and grinding bodies can enter the accelerator 20. The three annular discs 21, 22, 23 define between them two conveyor chambers and, together with the guide paddles 24, form a two-chamber paddle wheel which, on rotation of the agitator shaft 5 (FIG. 1) and accordingly of the two-chamber accelerator 20 in direction of rotation P, conveys the mixture of material to be ground and grinding bodies located in the conveyor chambers towards the outside in the direction towards the periphery (cylindrical wall 2) of the grinding chamber 1.

The accelerator 30, referred to hereinbelow as a two-chamber end accelerator, is in principle constructed in the same way as the two-chamber accelerator 20. It comprises two annular outer discs 31 and 32 and a middle disc 33 between which there are arranged curved guide paddles 34 which extend obliquely inwards from the outer periphery of the discs in direction of rotation P. The two-chamber end accelerator 30 is mounted at the free end of the agitator shaft 5, its middle disc 33 being screwed to the end of the agitator shaft. Alternatively the middle disc 33 could also be constructed in a similar way to the middle disc 23 of the accelerator 20 and be mounted on the agitator shaft. The middle disc 33 is again provided with a series of openings 35 close to the agitator shaft, and the two outer discs 31 and 32 each have a central opening 36 of relatively large diameter. The openings 35 can also be directed at an angle of from 40° to 50° with respect to the axis of the agitator shaft or can be of slotted construction. The three discs 31, 32, 33 define between them two conveyor chambers and, together with the guide paddles 34, again form a two-chamber paddle wheel, but the guide paddles between the middle disc 33 and the outer disc 33 that faces towards the outlet 7 are wider in the axial direction than the guide paddles between the middle disc 33 and the other outer disc 31. The two-chamber end accelerator 30, with its wider guide paddles, overlaps the separator screen 8 (FIG. 1).

FIG. 1 and also FIGS. 7 and 11 to 13 indicate some typical dimensions of the grinding chamber 1 and the accelerators 10, 20 and 30. D denotes the internal diameter of the grinding chamber 1 or the cylindrical wall 2 thereof. Dimension $d_a$ denotes the external diameter (normally the same for all accelerators) of the accelerators 10, 20 and 30. It is typically from 75% to 90% of the grinding chamber diameter D. The dimension $d_i$ denotes the diameter (normally the same for all accelerators) of the central openings 16, 26 and 36 of the accelerators 10, 20 and 30. It is typically from 70% to 80% of the outer diameter $d_a$. Dimensions c1, c2 and c3 denote the total widths of the accelerators 10, 20 and 30 measured in the axial direction. The dimension k denotes the conveyor chamber widths of the accelerators 10, 20 and 30 defined by the internal spacing of two adjacent discs 11, 12 or 21, 23 and 23, 22 or 31, 33 of the accelerators 10, 20 and 30. They are typically from 5% to 15% of the outer diameter $d_a$. Dimension a denotes the axial spacing between the accelerator closest to the inlet-side end wall 3 and the end wall. It is typically from 10% to 15% of the outer diameter $d_a$. The dimensions b1 and b2 denote the axial spacings between two adjacent accelerators. The spacings b1 and b2 between the accelerators 10, 20 and 30 will be discussed in detail hereinbelow.

During operation of the agitator ball mill, the mixture consisting of material being ground or dispersed and grinding bodies enters the accelerators or agitator elements 10, 20 and 30 through the openings 16 and 26 and 36, respectively, close to the agitator shaft and is conveyed outwards through the conveyor chamber(s) thereof out of the accelerators or agitator elements into the peripheral region, i.e. the region close to the cylindrical wall, of the grinding chamber 1. From there a portion of the mixture flows in the aforementioned grinding body cycle laterally alongside and between the accelerators into the region close to the agitator shaft again and is thence sucked into the accelerators again. The ground or dispersed material is discharged from the grinding chamber through the outlet 7. The openings 15 or 25 or 35 serve to equalise an axial grinding body gradient: during operation, some of the grinding bodies are carried downstream (in the direction from the inlet to the outlet) from one conveyor chamber to the next. The openings 15 or 25 and 25, by virtue of their inclination, have the capacity to convey the grinding bodies upstream and in that way equalise the grinding body gradient.

To that extent, in terms of its structure and mode of operation the agitator ball mill according to the invention corresponds to the prior art, as represented, for example, by WO 2010/112274 A1, EP 0 627 262 B1 or EP 2 272 591 B1 already mentioned above. The person skilled in the art therefore requires no further explanation in that regard.

In order to counteract the problem underlying the invention, which problem is that of the compaction of the grinding bodies in the region of the grinding chamber close to the cylindrical wall, in accordance with a first inventive concept special return conveyor elements are arranged in the grinding chamber 1, which return conveyor elements ensure that the said mixture, together with as far as possible all the grinding bodies contained therein, is returned from the region of the grinding chamber close to the cylindrical wall to the region close to the agitator shaft.

Figure 5:
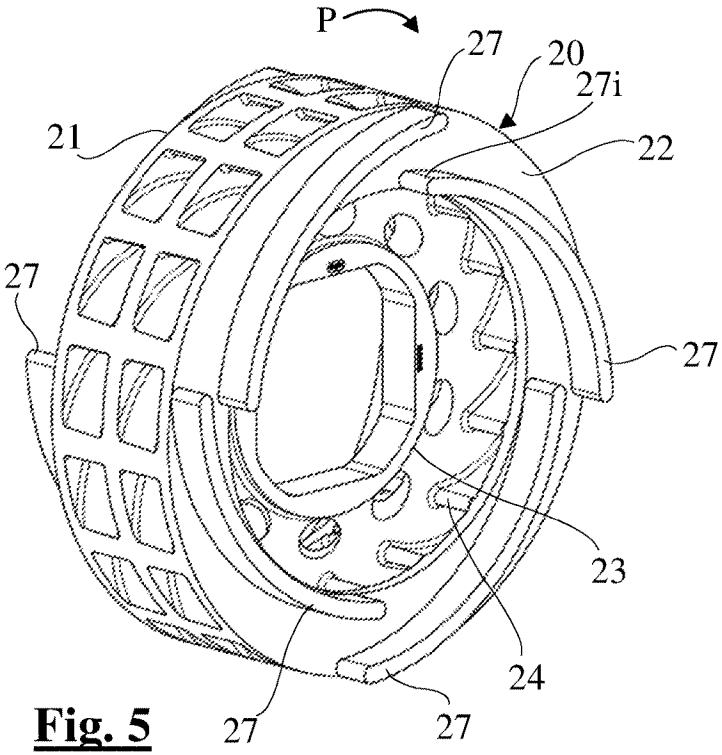
FIG. 5 is a perspective oblique view of an accelerator used in the agitator ball mill of FIG. 1.

In the exemplary embodiment of the agitator ball mill according to FIG. 1, those return conveyor elements are arranged laterally on one or both of the outer discs 11 or 21 and 22 or 31 of the accelerators 10, 20 and 30 (they project from the respective lateral end faces of the outer discs 11 or 21 in the direction of the rotational axis of the agitator shaft) and are denoted therein by reference numerals 17, 27 and 37. The detail view in FIG. 5, which shows the accelerator 20 of FIG. 1 in isolation in an oblique perspective view, clearly shows the shape and arrangement of the return conveyor elements 27.

On each of the two outer annular discs 21 and 22 of the accelerator 20 there are arranged four return conveyor elements, in the form of return conveyor paddles 27, which are curved in the direction of rotation P of the accelerator 20. The return conveyor paddles 27 are in principle constructed in a similar way to the guide paddles 24 of the accelerator 20 but are oppositely angled in respect of the direction of rotation so that, on rotation of the accelerator 20 in direction of rotation P, they give rise to a conveying effect in the reverse direction, that is to say from the outside to the inside in the direction towards the agitator shaft. The number of return conveyor paddles 27 per side of the accelerator 20 can also be less than or greater than four and can be, for example, up to twenty.

In the case of the accelerators 10 and 30, the return conveyor elements are likewise constructed in the form of return conveyor paddles 17 and 37, respectively, and are arranged in the same way as in accelerator 20, but in the exemplary embodiment here only on one side of the accelerator 10 or 30. The number of return conveyor paddles can likewise be less than or greater than four and can likewise be, for example, up to twenty.

Figure 6:
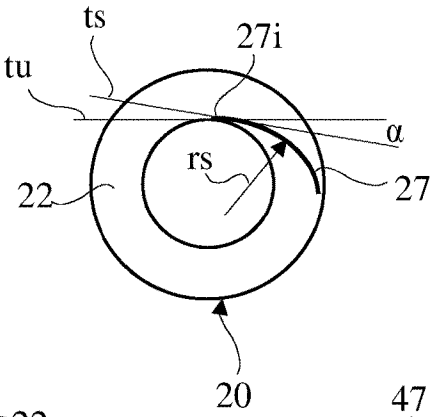
FIG. 6 is a sketch clarifying the positioning of various elements of the agitator ball mill relative to one another.

The height h of the return conveyor paddles 17, 27 and 37 measured in the axial direction is approximately from 5% to 15% of the outer diameter $d_a$ of the accelerators 10, 20 and 30 (FIG. 1). The radius of curvature $r_s$ of the return conveyor paddles 17, 27 and 37 is preferably approximately from 40% to 70% of the outer diameter $d_a$ (FIG. 1) of the accelerators 10, 20 and 30 (FIG. 6). The angle a enclosed between the circumferential direction $t_u$ at the location of the inner ends 27*i* of the return conveyor paddles 17, 27 and 37 and the tangent $t_s$ to the inner ends of the return conveyor paddles is approximately from 5° to 30° (FIG. 6).

The return conveyor paddles 17, 27 and 37 firstly generate a flow-field directed inwards towards the agitator shaft, which increases the tractive forces of the material being ground and/or dispersed. Secondly, grinding bodies that come into contact with those return conveyor paddles are given an impetus that is likewise directed inwards towards the agitator shaft. Both support the maintenance of the desired grinding body cycle.

Figure 7:
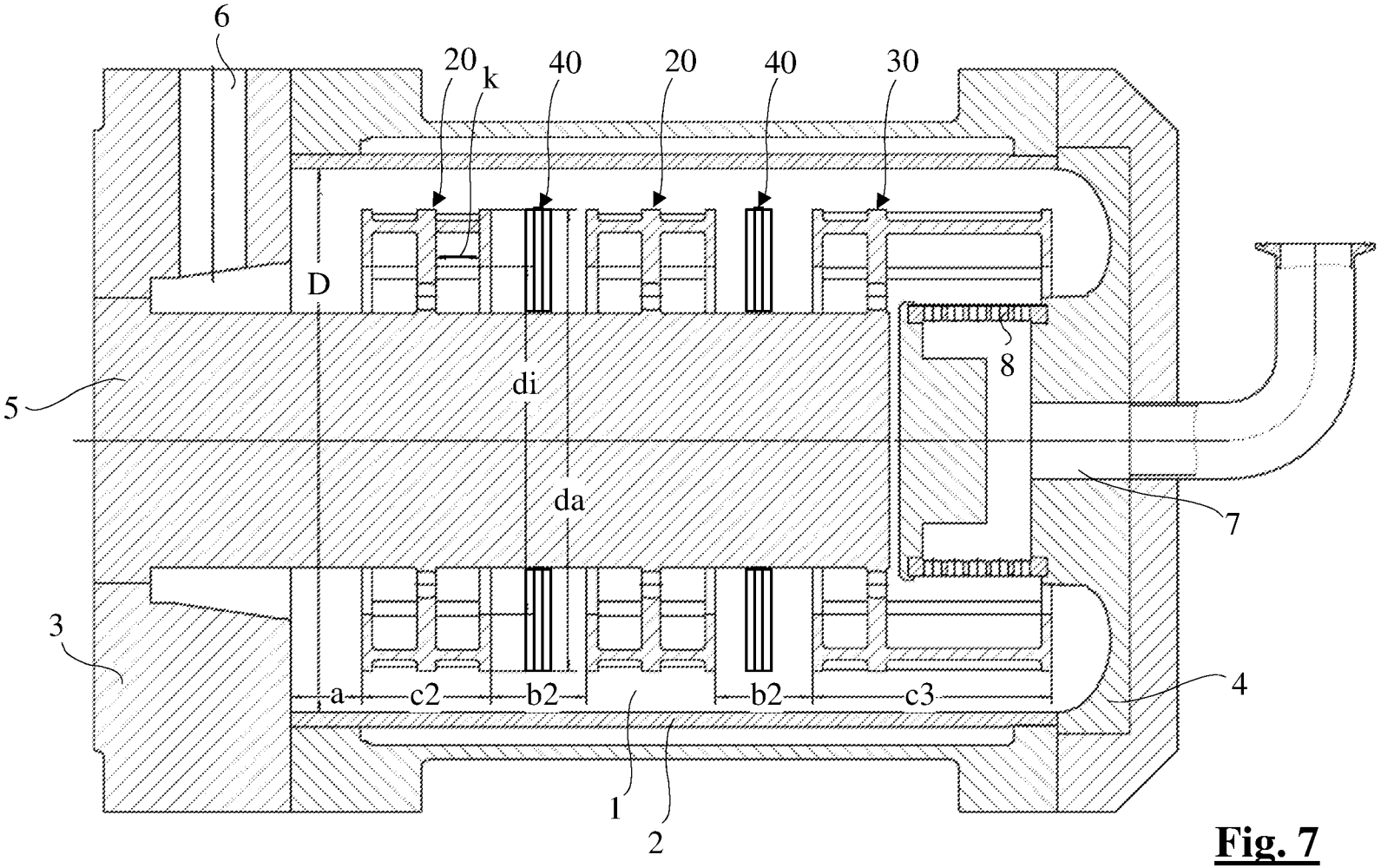
FIG. 7 shows an axial section through a second exemplary embodiment of the agitator ball mill according to the invention.

FIG. 7 shows a second exemplary embodiment of the agitator ball mill according to the invention. A first difference with respect to the exemplary embodiment of FIG. 1 is that on the agitator shaft 5, instead of the single-chamber accelerator 10, a further two-chamber accelerator 20 is arranged on the agitator shaft. Unlike the exemplary embodiment of FIG. 1, however, here the return conveyor elements are not arranged on the agitator elements or accelerators 20 and 30 but are formed as separate return conveyor units 40 and are preferably arranged midway between two accelerators in each case.

Figure 8:
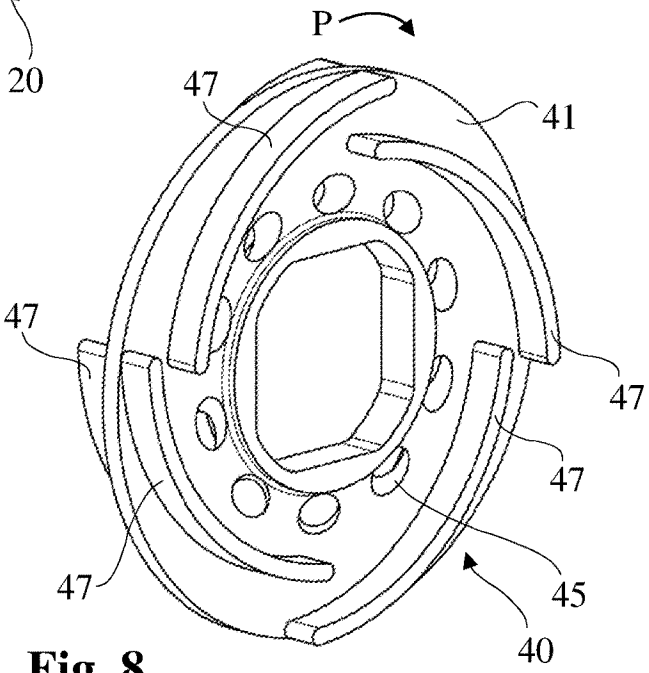
FIG. 8 is a perspective oblique view of a conveyor disc of the agitator ball mill of FIG. 7.

FIG. 8 shows the construction of such a return conveyor unit 40 in an oblique perspective view. It consists of a disc-shaped carrier 41 and four return conveyor paddles 47 arranged on each side of the carrier. The carrier 41 is arranged on the agitator shaft 5 (FIG. 6) and is joined thereto for conjoint rotation therewith. In addition, the carrier 41 has, in the region close to the agitator shaft, a series of openings 45 through which the material to be ground/grinding bodies mixture can flow. The openings 45 can also be directed at an angle of from 40° to 50° with respect to the axis of the agitator shaft or can be of slotted construction. The arrangement, construction and number of the return conveyor paddles 47 are the same as described in connection with FIG. 5 and FIG. 6 and therefore require no further explanation.

It will be understood that it is also possible to combine the two described exemplary embodiments to some extent and to provide return conveyor paddles on the accelerators as well as one or more independent return conveyor units.

Figure 10:
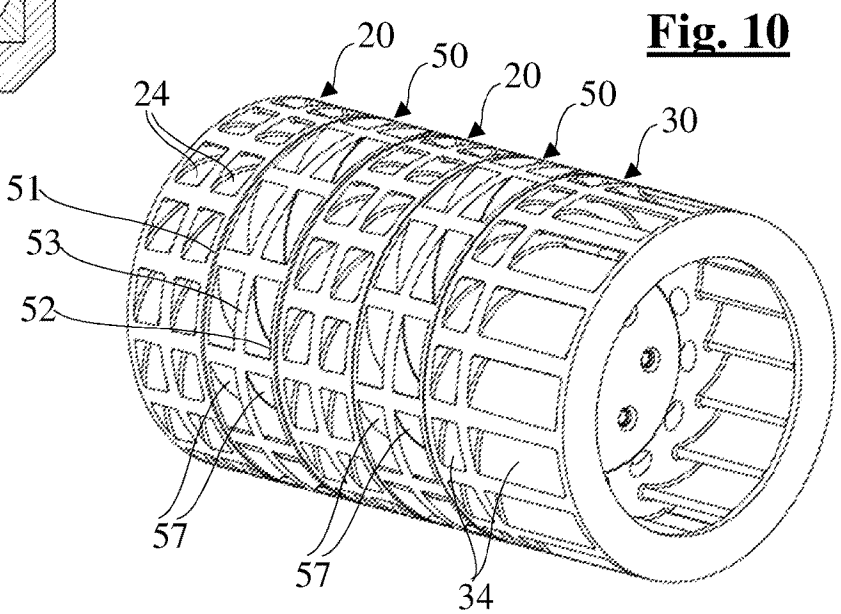
FIG. 10 is a perspective oblique view of elements arranged on the agitator shaft of the agitator ball mill of FIG. 9, and FIG. 11-13 show three further exemplary embodiments of the agitator ball mill according to the invention, each in an axial section.
Figure 9:
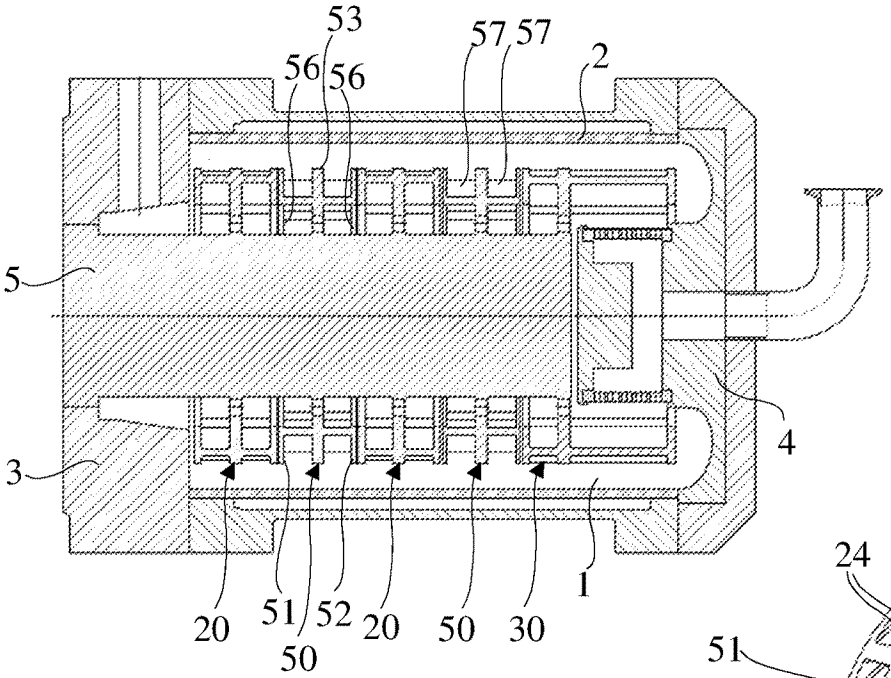
FIG. 9 shows an axial section through a third exemplary embodiment of the agitator ball mill according to the invention.

FIGS. 9 and 10 show a third exemplary embodiment of the agitator ball mill according to the invention. Here, as in the exemplary embodiment of FIG. 7, there are arranged on the agitator shaft 5 in the grinding chamber 1 two two-chamber accelerators 20 and a two-chamber end accelerator 30 which are likewise not all equipped with return conveyor paddles. Unlike the first two exemplary embodiments, in this exemplary embodiment a return conveyor unit 50, in the form of a two-chamber paddle wheel, is arranged between two adjacent accelerators of the three accelerators. The return conveyor units 50 are in principle constructed in the same way as the paddle-wheel-like two-chamber accelerators 20. Accordingly, they have three annular discs 51, 52 and 53 and, therebetween, curved return conveyor paddles 57 which are angled obliquely inwards. The return conveyor paddles 57 are, however, oppositely angled to the guide paddles 24 and 34 in the accelerators 20 and 30 (that is to say obliquely inwards against the direction of rotation), so that, with the same direction of rotation, an oppositely directed conveying effect is obtained. The middle disc 53 is mounted on the agitator shaft 5 for conjoint rotation therewith and has a series of passage openings (not shown) in its region close to the agitator shaft. The openings can also be directed at an angle of from 40° to 50° with respect to the axis of the agitator shaft or can be of slotted construction. The two outer discs 51 and 52 each have a central opening 56 of relatively large diameter. The discs 51, 53 and the discs 52, 53 in each case define between them a conveyor chamber, that is to say in total two conveyor chambers, and together with the return conveyor paddles 57 form a two-chamber paddle wheel analogous to the two-chamber accelerator 20, but with the conveying direction being from the outside towards the inside instead of from the inside towards the outside. In principle, the return conveyor unit 50 could also be implemented by a two-chamber accelerator 20 mounted on the agitator shaft 5 "the other way round" in terms of its orientation. As regards the shape, arrangement and number of the return conveyor paddles 57, the considerations that apply are the same as those discussed in connection with the first two exemplary embodiments.

The return conveyor units 50 can be arranged between the individual accelerators axially spaced apart from the accelerators or preferably between the accelerators without a gap, in which case an especially compact design is obtained. It will be understood that in principle it is also possible to construct a paddle-wheel-like single-chamber return conveyor unit analogously to the accelerator 10.

Figure 11:
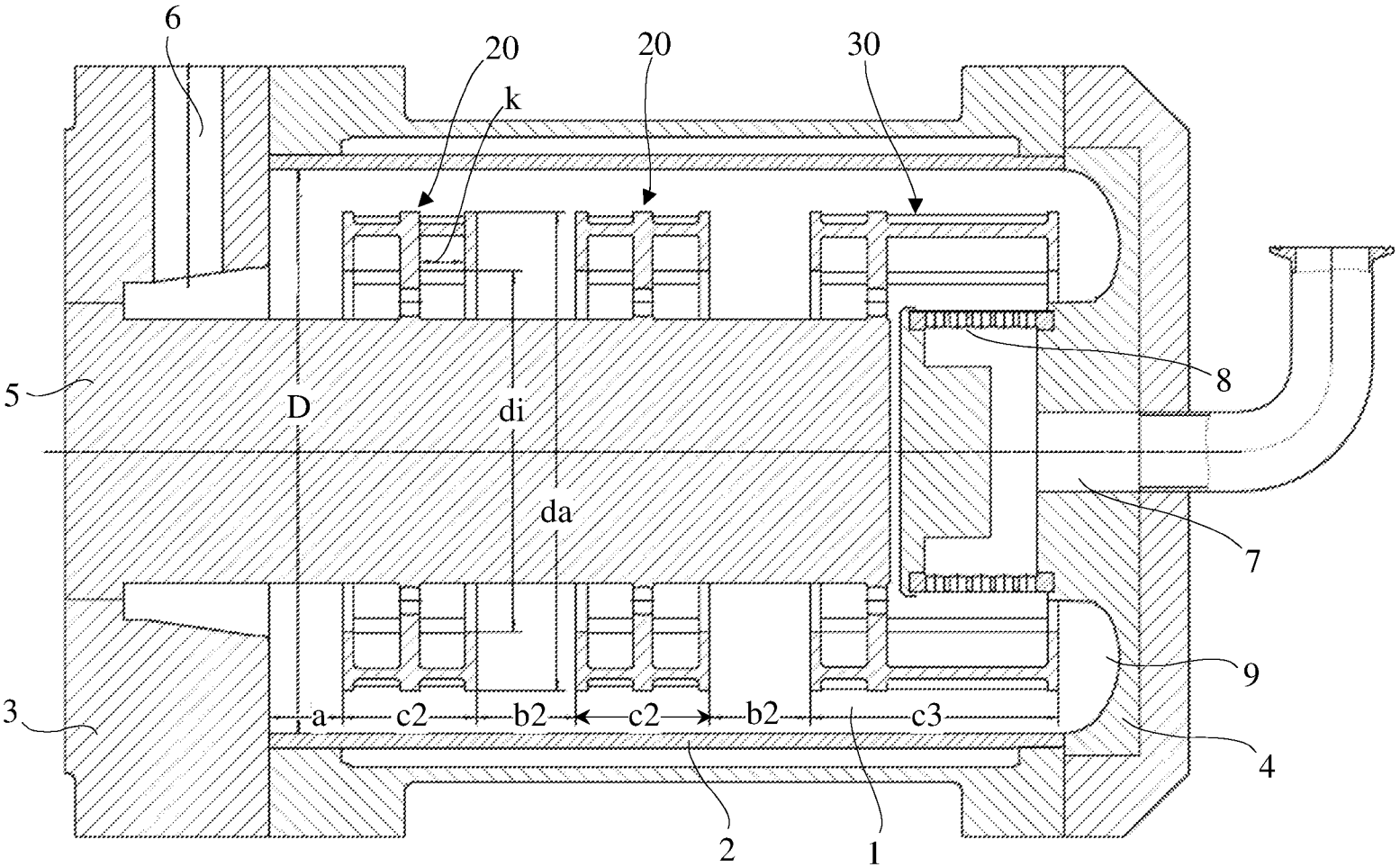
Figure 12:
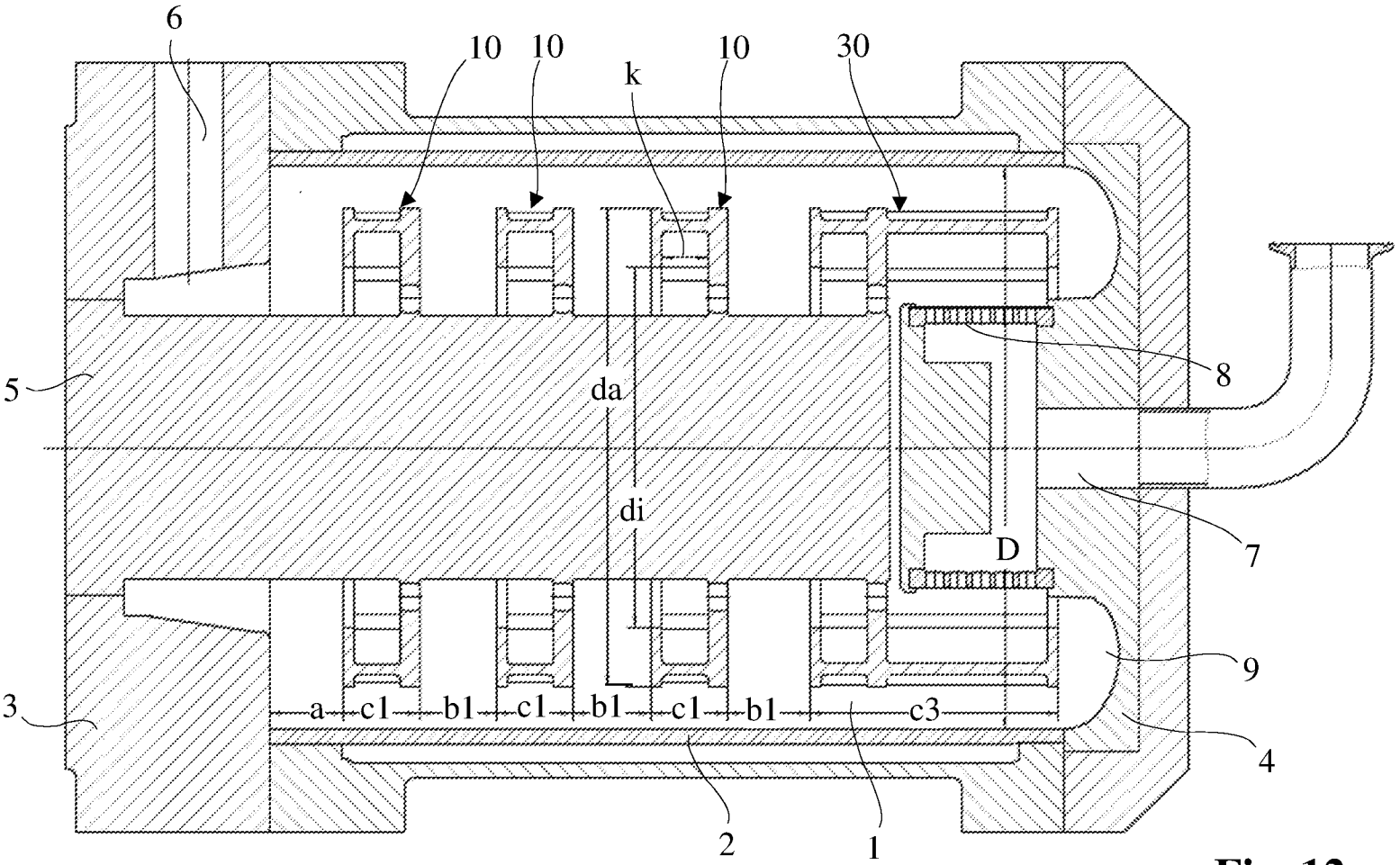
Figure 13:
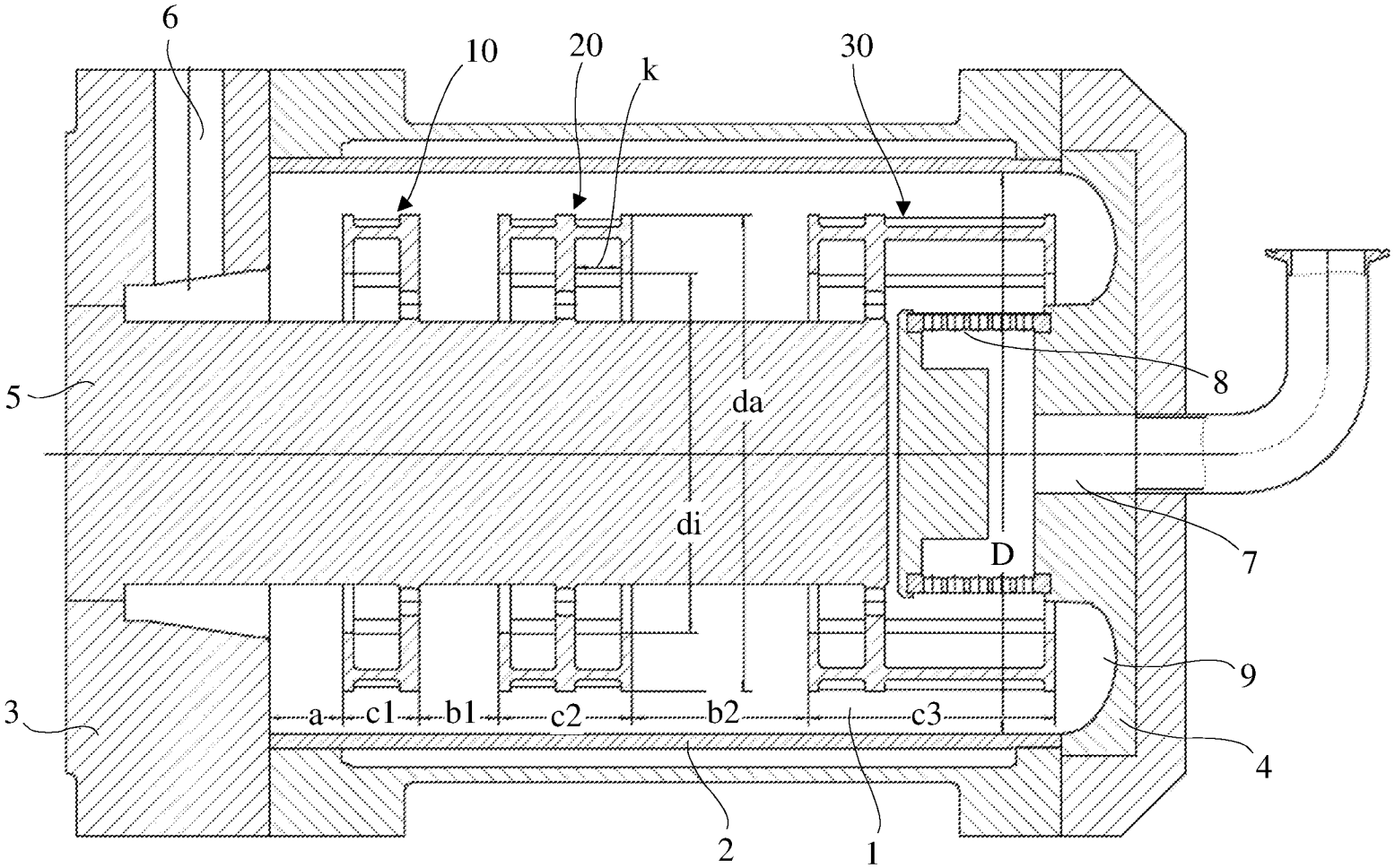

FIGS. 11 to 13 show three further exemplary embodiments of the agitator ball mill according to the invention, each in an axial section. Each of the three exemplary embodiments comprises a substantially cylindrical grinding chamber 1 which is bounded by a cylindrical wall 2 and by an inlet-side end wall 3 and an outlet-side end wall 4. Passing through the inlet-side end wall 3 there is an agitator shaft 5 which is rotatably mounted externally or in the end wall and on which paddle-wheel-like agitator elements or accelerators are arranged spaced apart from one another axially inside the grinding chamber 1. The accelerators are joined to the agitator shaft for conjoint rotation therewith and during operation are driven in rotation thereby. In the vicinity of the inlet-side end wall 3 there is arranged an inlet 6 for supplying material to be ground and grinding bodies and in the outlet-side end wall 4 there is provided an outlet 7 for removal of the ground material, which outlet is separated from the grinding chamber 1 by a separator screen 8 that holds back grinding bodies. In the outlet-side end wall 4 there is an annular channel 9 which is open towards the interior of the grinding chamber 1.

The agitator ball mill of FIG. 11 corresponds in principle to that of FIG. 7 and comprises two two-chamber accelerators 20 and a two-chamber end accelerator 30. The agitator ball mill of FIG. 12 comprises three single-chamber accelerators 10 and a two-chamber end accelerator 30. The agitator ball mill of FIG. 13 corresponds in principle to that of FIG. 1 and comprises a single-chamber accelerator 10, a two-chamber accelerator 20 and a two-chamber end accelerator 30. The accelerators 10, 20 and 30 are constructed as described in connection with FIGS. 2 to 4 and therefore need no further explanation.

Unlike the exemplary embodiments of FIGS. 1, 7 and 9, in the three exemplary embodiments of FIGS. 11 to 13 of the agitator ball mill there are no return conveyor elements. The problem of grinding body compaction in the region of the grinding chamber close to the cylindrical wall is solved in these exemplary embodiments, in accordance with a second independent inventive concept, by creating structural conditions in which the grinding bodies are carried along by the material being ground and/or dispersed and are thus fed into the grinding body cycle. Those conditions are met if the free volume defined by the conveyor chamber width k inside the accelerators is in a specific ratio to the volume defined by the spacing b1 or b2 between two adjacent accelerators. The ratio selected is such that the distance covered by the grinding bodies is long enough for the latter to lose sufficient kinetic energy on their way, so that the resulting inertial forces are less than the tractive forces of the material being ground and/or dispersed. On the other hand, that "calming distance" is chosen to be short enough for the kinetic energy to retain a sufficiently high level to maintain the desired intensive mechanical stress on the material being ground and/or dispersed.

The necessary ratio between the free volume defined by the channel width k inside an accelerator and the volume defined by the spacing between two adjacent accelerators is realised according to the invention by special dimensioning of the spacings b1 and b2 between the accelerators.

In the exemplary embodiment of FIG. 11, the spacings b2 between the two two-chamber accelerators 20 and between the middle two-chamber accelerator 20 and the two-chamber end accelerator 30 are in the range of from 30% to 40% of the outer diameter $d_a$ of the accelerators 20 and 30.

In the exemplary embodiment of FIG. 12, the spacings b1 between two single-chamber accelerators 10 and the spacing b1 between the third single-chamber accelerator 10 and the two-chamber end accelerator 30 are in the range of from 10% to 20% of the outer diameter $d_a$ of the accelerators 10 and 30.

In the exemplary embodiment of FIG. 13, the spacing b1 between the single-chamber accelerator 10 and the adjacent two-chamber accelerator 20 is in the range of from 10% to 20% of the outer diameter $d_a$ of the accelerators 10, 20 and 30 and the spacing b2 between the two-chamber accelerator 20 and the two-chamber end accelerator 30 is in the range of from 30% to 40% of the outer diameter $d_a$ of the accelerators 10, 20 and 30.

In general, the ratio between the free volume defined by the conveyor chamber width k inside an accelerator and the volume defined by the spacings b1 and b2 between two adjacent accelerators necessary for establishing the above-mentioned conditions is achieved by the dimensioning specified below:

1. The spacing b1 between a single-chamber accelerator 10 and an adjacent single-chamber accelerator 10 or between a single-chamber accelerator 10 and an adjacent two-chamber accelerator 20 or 30 is in the range of from 10% to 20% of the outer diameter $d_a$ of the accelerators.

2. The spacing b2 between two adjacent two-chamber accelerators 20 or 30 is in the range of from 30% to 40% of the outer diameter $d_a$ of the accelerators.

The described dimensioning of the spacings between the accelerators 10, 20 and 30 can advantageously also be used in the exemplary embodiments equipped with return conveyor elements according to FIGS. 1 and 7. To clarify such a possible combination, the spacings b1 and b2 are likewise indicated in those Figures. The optimised enlargement of the spacings between the accelerators in accordance with the dimensioning specified above, in combination with the use of return conveyor elements, results in a further improvement of the grinding body cycle.

The invention has been explained above with reference to exemplary embodiments, but is not intended to be limited to those exemplary embodiments; rather, the person skilled in the art will be able to imagine numerous modifications without departing from the teaching of the invention. For example, it is also possible for more than three agitator elements having return conveyor elements arranged thereon or therebetween to be provided in the grinding chamber. The scope of protection is therefore defined by the following patent claims.

The invention claimed is:

1. Agitator ball mill having a grinding chamber, a rotatably mounted agitator shaft, which protrudes at least partly into the grinding chamber and on which agitator elements are arranged spaced apart from one another axially inside the grinding chamber, and further having an inlet for supplying material to be ground and grinding bodies as well as an outlet for removal of ground material, wherein the agitator elements each have at least one conveyor chamber and are constructed in such a way that, during operation, the agitator elements convey a mixture consisting of the material to be ground and the grinding bodies through their at least one conveyor chamber outwards away from the agitator shaft, and wherein in the grinding chamber there are arranged return conveyor paddles which are joined to the agitator shaft for conjoint rotation therewith and which are configured to, during operation, convey the mixture inwards towards the agitator shaft, either laterally alongside or between the agitator elements, or laterally alongside and between the agitator elements.

2. The agitator ball mill according to claim 1, wherein the return conveyor paddles are arranged laterally on the agitator elements.

3. The agitator ball mill according to claim 1, wherein the return conveyor paddles are arranged spaced apart laterally alongside or between the agitator elements.

4. The agitator ball mill according to claim 3, wherein the return conveyor paddles are arranged laterally on at least one separate carrier which is joined to the agitator shaft for conjoint rotation therewith.

5. The agitator ball mill according to claim 1, wherein the agitator elements are in the form of paddle wheels and have guide paddles which are angled obliquely inwards from the outside in the direction of rotation of the agitator elements and wherein the return conveyor paddles are angled obliquely inwards from the outside against the direction of rotation of the agitator elements.

6. The agitator ball mill according to claim 1, wherein the return conveyor paddles are arranged in at least one return conveyor unit, constructed in the form of a paddle wheel, which is joined to the agitator shaft for conjoint rotation therewith.

7. The agitator ball mill according to claim 1, wherein the return conveyor paddles are constructed so as to be curved in the direction of rotation.

8. The agitator ball mill according to claim 7, wherein the agitator elements have an outer diameter and the radius of curvature of the return conveyor paddles is from 40% to 70% of the outer diameter (da) of the agitator elements.

9. The agitator ball mill according to claim 1, wherein the return conveyor paddles each have an inner end and an outer end, wherein the return conveyor paddles, at their respective inner ends, enclose an angle with a circumferential direction at the location of the respective inner end and with a tangent to the respective inner end, which angle is in the range of from 5° to 30°.

10. The agitator ball mill according to claim 1, wherein the agitator elements arranged on the agitator shaft are in the form of single-chamber agitator elements or in the form of two-chamber agitator elements and each have the same outer diameter, and wherein the spacing between a single-chamber agitator element and an adjacently arranged single-chamber agitator element is in the range of from 10% to 20% of the outer diameter of the agitator elements, and wherein the spacing between a two-chamber agitator element and an adjacently arranged two-chamber agitator element is in the range of from 30% to 40% of the outer diameter of the agitator elements.

11. The agitator ball mill according to claim 1, wherein the agitator elements arranged on the agitator shaft are in the form of single-chamber agitator elements and in the form of two-chamber elements and each have the same outer diameter, wherein in case of a single-chamber agitator element being adjacently arranged on the agitator shaft to another single-chamber agitator element, the distance between such adjacently arranged single-chamber agitator elements is between 10% and 20% of the outer diameter of the agitator elements, wherein in the case of a single-chamber agitator element being adjacently arranged on the agitator shaft to a two-chamber agitator element, the distance between such adjacently arranged single-chamber and two-chamber agitator elements is between 10% and 20% of the outer diameter of the agitator elements, and wherein in case of a two-chamber agitator element being adjacently arranged on the agitator shaft to another two-chamber agitator element, the distance between such adjacently arranged two-chamber elements is between 30% and 40% of the outer diameter of the agitator elements.

12. The agitator ball mill according to claim 5, wherein the guide paddles which are angled obliquely inwards from the outside in the direction of rotation of the agitator elements are constructed so as to be curved in the direction of rotation of the agitator elements.

* * * * *